United States Patent [19]

Groos et al.

[11] 4,136,740

[45] Jan. 30, 1979

[54] LARGE DROP SPRINKLER HEAD FOR HIGH HEAT OUTPUT FIRES

[75] Inventors: Richard T. Groos; Gerald W. Sanders, both of Hastings, Mich.

[73] Assignee: The Viking Corporation, Hastings, Mich.

[21] Appl. No.: 809,169

[22] Filed: Jun. 23, 1977

[51] Int. Cl.[2] ..... A62C 37/10; B05B 1/26

[52] U.S. Cl. ..... 169/39; 239/500; 239/524

[58] Field of Search ..... 239/499, 500, 518, 524; 169/37–42

[56] References Cited

U.S. PATENT DOCUMENTS

| | | | |
|---|---|---|---|
| 2,664,956 | 1/1954 | Barz | 169/38 |
| 2,697,008 | 12/1954 | Rowley | 239/500 X |
| 2,724,614 | 11/1955 | Rider | 239/500 X |

FOREIGN PATENT DOCUMENTS

| | | | |
|---|---|---|---|
| 765125 | 1/1957 | United Kingdom | 169/37 |

*Primary Examiner*—Robert W. Saifer
*Assistant Examiner*—Andres Kashnikow
*Attorney, Agent, or Firm*—Price, Heneveld, Huizenga & Cooper

[57] ABSTRACT

A large drop sprinkler head is disclosed including a nozzle, a pair of arms extending outwardly and upwardly from the nozzle and joined at their ends in coaxial alignment with the nozzle. A concave, plate distributor is supported by the arms coaxially with the nozzle. The plate distributor includes a central, cup-like portion and an outwardly, downwardly directed, annular plate. A large drop deflector is disposed within the cup-like portion of the plate distributor. The large drop deflector includes a plurality of equally spaced tines or fingers which extend downwardly towards the nozzle. The plate distributor defines a shoulder and the tines extend generally perpendicular to the plate distributor and beyond the plane of the shoulder.

14 Claims, 8 Drawing Figures

LARGE DROP SPRINKLER HEAD FOR HIGH HEAT OUTPUT FIRES

BACKGROUND OF THE INVENTION

This invention relates to fire protection systems, more particularly, to an improved spinkler head for use in automatic sprinkler systems.

Heretofore, various forms of sprinkler heads have been proposed for use in sprinkler systems. Typically, sprinkler heads include a body defining a nozzle and a frame having a pair of arms which extend from the nozzle and which are joined at a frusto-conical portion opposite and coaxially aligned with the nozzle. Some form of distributor plate is usually attached to the frame at the frusto-conical portion to prevent upward spray of the liquid issuing from the nozzle. Examples of such prior sprinkler heads may be found in U.S. Pat. No. 2,664,956, entitled SPRINKLER HEAD, issued on Jan. 5, 1954 to Barz; U.S. Pat. No. 2,697,008, entitled SPRINKLER HEAD, issued on Dec. 14, 1954 to Rowley and U.S. Pat. No. 2,724,614, entitled SPRAY SPRINKLER, issued on Nov. 22, 1955 to Rider.

The sprinkler heads of the type exemplified by these aforementioned prior patents include deflectors and/or distributor plates which are configured and interact to atomize or finely divide the liquid emanating from the sprinkler head. Such atomizing sprinkler heads have been ineffective in controlling fast-burning, high-heat output fires.

A system employing present atomizing sprinkler heads in order to effectively control and extinguish such high-heat output fires, requires a large number of heads installed over the area, an increase in the extent and size of piping, an increase in the sizing of the fire pump as well as the capacity of the pump suction tank. These design requirements are such that the cost of the system may become prohibitive.

Fires of the type under consideration produce a burst of flame generally known as a fire plume. The fire plume or burst of flame may rise as fast as 55 feet per second. The small or finely divided drops of water produced by the standard, atomizing sprinkler heads, as exemplified by the aforementioned patents, are unable to effectively penetrate the fire plume and extinguish the burning material. The violent drafts produced by these fires blow the water sideways and upwards so that effective quantities of water do not reach the seat of the fire. Temperatures at the ceiling of the building increase drastically as the fire intensifies and spreads. The steel or reinforced concrete of the building may be severely damaged. Such high heat output fires produce 250,000 BTU per minute or more. It should therefore be apparent that conventional sprinkler designs and layouts are unable to control let alone extinguish such high-heat output fires.

A need exists for an improved, sprinkler head having increased fire extinguishing effectiveness for a given water supply, which is capable of controlling and extinguishing high-heat output fires such as those associated with stacked plastic material, which results in a reduction in installation costs for systems protecting such areas by reducing pipe size requirements and/or permitting wider sprinkler spacing and lower water capacities and which may be used as a replacement in existing sprinkler systems.

SUMMARY OF THE INVENTION

In accordance with the present invention, a unique upright sprinkler head capable of producing large drops is provided and whereby the problems heretofore experienced are substantially eliminated. Essentially, the sprinkler head includes a body defining a nozzle and a pair of arms extending outwardly and upwardly from the nozzle, a concave plate distributor and a large drop deflector means. The concave plate distributor is secured to the arms of the body concentrically with the nozzle and includes a downwardly opening cup-like portion within which the large drop deflector means is disposed. A concentric wall formed by the cup-like portion cooperates with the deflector means to produce relatively large drops compared to state of the art deflectors which in combination with the concave plate distributor results in the generation of large liquid drops capable of effectively penetrating the fire plume associated with high-heat output fires.

DETAILED DESCRIPTION OF THE PREFERRED EMBODIMENT

Figure 1:
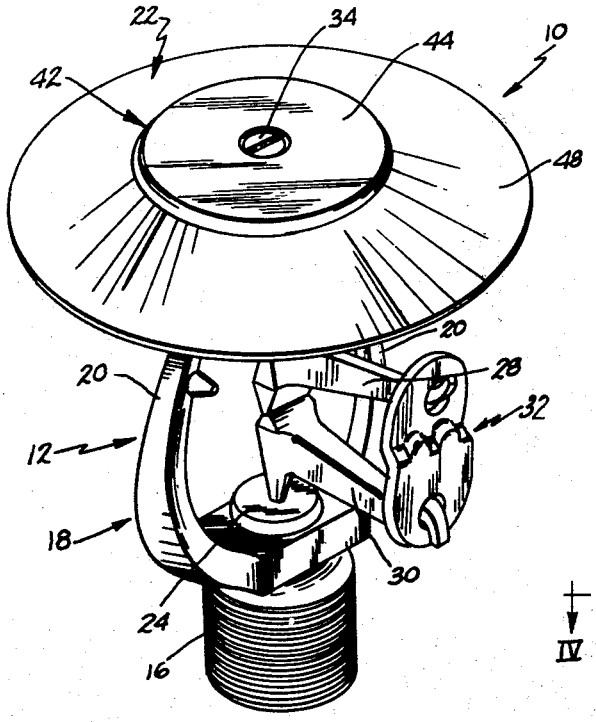
FIG. 1 is a perspective view of the unique sprinkler head in accordance with the present invention.
Figure 2:
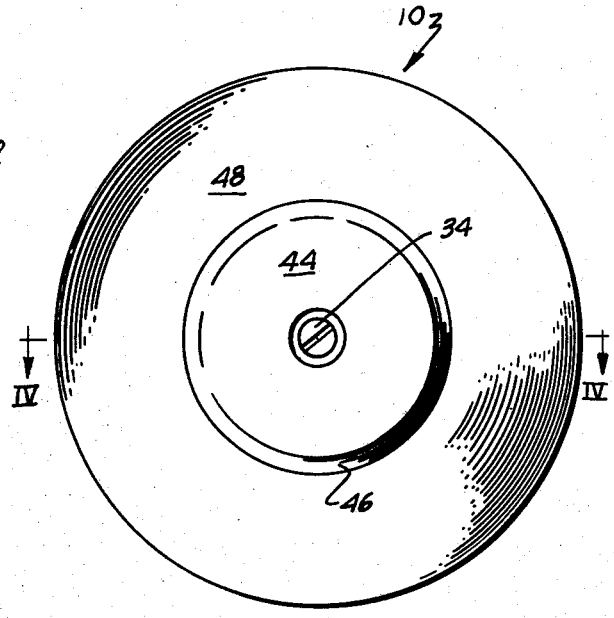
FIG. 2 is a top plan view thereof.
Figure 3:
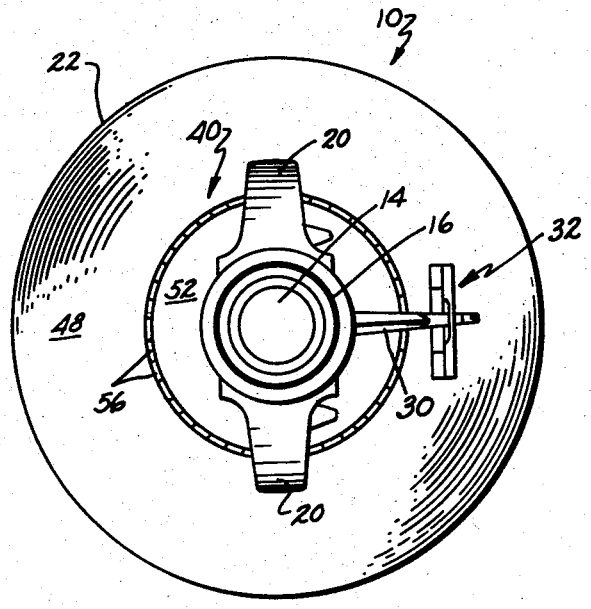
FIG. 3 is a bottom plan view thereof.

The preferred embodiment of the large drop, upright sprinkler head in accordance with the present invention is illustrated in FIGS. 1–3 and generally designated 10. The sprinkler 10 includes a body 12 defining a nozzle 14 extending through an externally threaded portion 16. A frame 18 including arms 20 extends upwardly from the nozzle defining portion of the body 16. Supported concentrically with and opposite the nozzle 14 on the arms 20 is a large deflector or distributor 22.

Figure 4:
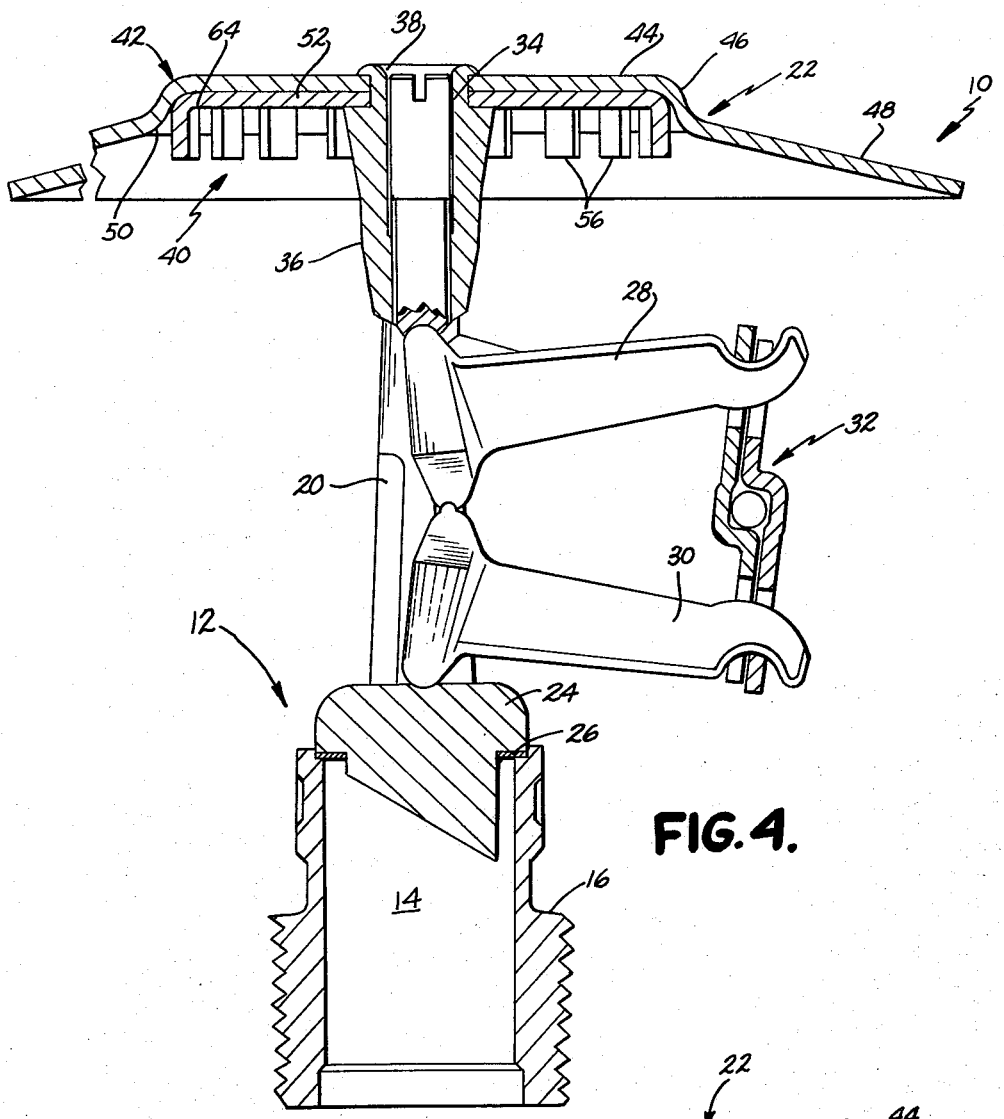
FIG. 4 is an enlarged cross-sectional view taken generally along line IV—IV of FIG. 2.

As seen in FIGS. 1 and 4, a cap 24 is dimensioned to fit within the discharge end of the nozzle 14. A Teflon tape coated washer 26 is disposed between cap 24 and portion 16 of the body for sealing purposes. As presently preferred, the washer 26 is fabricated from 0.010 inch copper coil and Teflon tape is applied to each side thereof. A conventional female lever 28, male lever 30 and fusible link assembly 32 are positioned between a compression screw 34 and the cap 24. The levers 28, 30 and the link assembly 32 are of a conventional nature and hold the cap in place until the solder portion of the fusible link is melted permitting water pressure to force the cap 24 from the nozzle 14.

As best seen in FIGS. 3 and 4, the upper portion of the arms 20 are joined at a frusto-conically shaped, slightly tapered member 36 opposite and coaxial to the nozzle 14. The member 36 defines a through bore 38 within which the compression screw 34 is threaded. As presently preferred, the body 12 is fabricated as a bronze casting. The cap 24 is fabricated from copper rod and the female and male levers 28, 30 are similarly fabricated as bronze castings.

Supported concentrically with the distributor 22 at the member 36 is a large drop deflector or small deflector 40. As will become readily apparent, the distributor element 22 and the large drop deflector 40 are configured and cooperate with each other in such a manner that the liquid emanating from the open nozzle 14 is distributed over a controlled area in the form of large, nonatomized drops. The structure cooperates to form drops having a size of 2 millimeters or larger and which are capable of effectively penetrating the fire plume of a fast burning, high-heat output fire such as is likely to occur in storage racks of high piled plastic material. A sprinkler head in accordance with the presently preferred embodiment is capable of producing in excess of 25% penetration of a fire plume rising at 42 feet per second and having a heat output of 260,000 BTU per minute when operated at water pressures of 5 to 25 psi.

Figure 5:
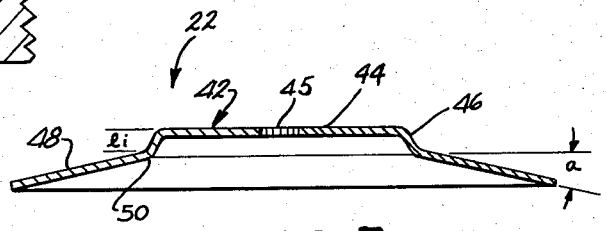
FIG. 5 is a cross-sectional view of the concave, plate distributor.

The deflector or distributor 22 as best seen in FIGS. 4 and 5 is fabricated as a concave, dish-like member and includes a central, downwardly opening cup-like portion 42. The cup portion 42 includes a base 44 having a central aperture 45 formed therein and a skirt or peripheral wall 46 which extends in a generally cylindrical fashion around the periphery of the circular generally planar base 44. Formed integral with the periphery of the skirt 46 and extending outwardly and downwardly therefrom is an annular plate or flange-like member 48. The plate portion 48 extends downwardly at an angle a relative to horizontal. The skirt 46 has a vertical dimension $l_i$.

The aperture 45, as seen in FIG. 4, is dimensioned to receive the upper end of the member 36. The member 36 may be crimped to retain the distributor on the body. The deflector 42 defines a shoulder 50 at the juncture of the flange or annular member 48 with the peripheral skirt 46. The distributor or large deflector 42, besides preventing upward spray of water from the nozzle 14, establishes the outer pattern of the water discharge due to the angling of the portion 48. The distributor 42, as will be more fully described below, cooperates with the large drop deflector 40 to produce the large drops which are capable of penetrating the fire plumes of high-heat output fires.

Figure 6:
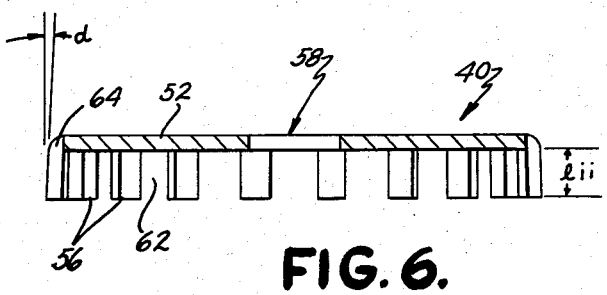
FIG. 6 is a cross-sectional view of the large drop deflector.
Figure 7:
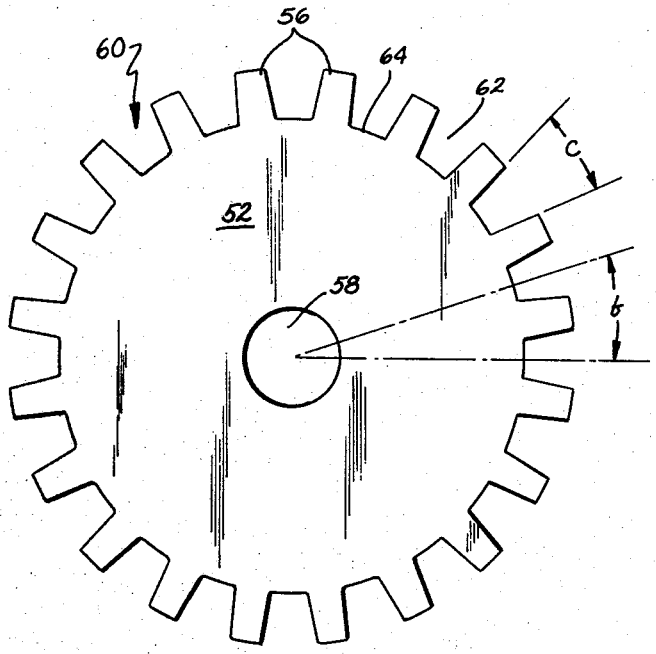
FIG. 7 is a plan view of a blank from which the large drop deflector is formed.
Figure 8:
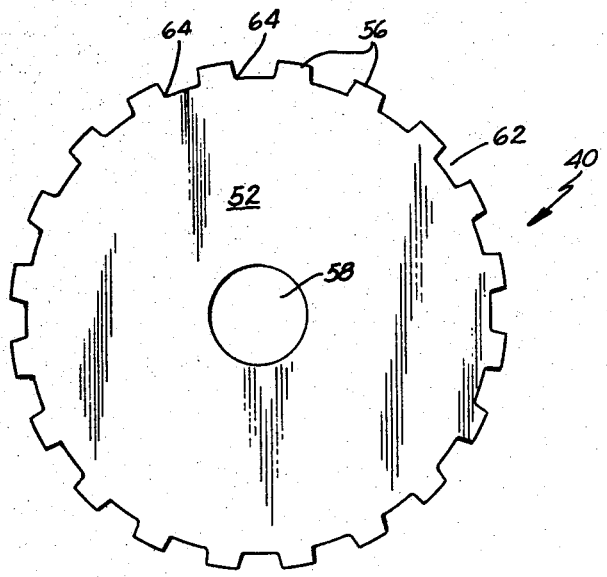
FIG. 8 is a bottom plan view of the large drop deflector.

As best seen in FIGS. 6, 7, and 8, the large drop deflector 40 includes a generally circular base member 52 having a diameter less than the diameter of the circular base 44 of the distributor 42. Positioned in a circular fashion at equally spaced intervals around the peripheral edge of the circular member 52 are a plurality of tines, teeth or fingers 56. The base 52 is provided with a central aperture 58 for receipt of the end portion of member 36 of the body 12.

As seen in FIG. 7, the large drop deflector may be fabricated from a blank generally designated 60. The blank 60 is formed to define the central circular member 52, the central aperture 58 and a plurality of radially extending teeth which form the tines or fingers 56. The teeth 56 extend radially outwardly at equally spaced intervals around the periphery of the central member 52. The spacing between adjacent teeth is such that they are equally positioned and spaced at intervals equal to angle b. In the presently preferred embodiment, the angle b or the included angle of spacing from the center of member 52 is approximately 18°. Also, each of the tines 56 is tapered and truncated. The taper as defined by the angle designated c in FIG. 7 is preferably 22°. The angle c is the included angle between adjacent sides of adjacent tines 56.

As seen in FIGS. 6 and 8, after the blank 60 is stamped, the tines are rolled or bent so that they extend away from the central portion 52. The tines join the central portion 52 and extend outwardly therefrom at an angle of approximately 90°. As seen in FIG. 6, it is presently preferred, however, that the angle the tines assume relative to the central circular member 52 be equal to 89°. As a result, the angle designated d in FIG. 6 would be equal to 1°. After the tines are bent, they extend radially outwardly from the center member 52 and then outwardly from the face of member 52. The tines have a vertical length $l_{ii}$ from the face of member 52 to their ends. The tines 56 define notches 62 and each tine 56 therefore includes a root or base 64 (FIG. 6).

As best seen in FIG. 4, the large drop deflector 40 is supported by the body 12 at the member 36 so as to be positioned concentric with the cup-like portion 42 of the distributor or large deflector 22. The shoulder 50 defined by the large deflector is positioned so that the angled portion or plate 48 extends outwardly and downwardly from a point beyond the roots or bases 64 of the tines of the large drop deflector 40. The tines 64 therefore terminate intermediate the shoulder 50 and the horizontal plane of the outer peripheral edge of the annular plate or flange 48.

This configuration serves two functions. First, the angle of the deflector establishes the outer pattern of water discharge. Second, the distance the shoulder 50 of the large deflector extends below the root 64 of the teeth, tines or fingers and the sharpness of the shoulder influences the thickness of the "sheet" of water on the face of member 52 and at the teeth of the large drop generating means 40.

In operation, the water issuing from the nozzle 14 will strike the circular portion 52 of the large drop deflector 40 and be directed outwardly as a thick sheet as opposed to the film type flow which results in conventional sprinkler heads. As the thick sheet of water passes through the notches 62 defined between adjacent teeth 64, contacts the teeth 64 and contacts the shoulder 50, large drops of liquid are generated. It is presently preferred that the sprinkler head deliver a liquid density of at least 0.30 GPM/Ft. Sq. at a distance from 3 to 6 feet radially from the sprinkler with the density dropping to no less than 0.05 GPM/Ft. Sq. at a point 9 feet from the sprinkler when the sprinkler is discharging water at a rate of 60 GPM. This large drop water density effectively controls and extinguishes the high-heat output fires of the type associated with piled plastic material.

In a presently existing embodiment of the unique sprinkler head in accordance with the present invention, the overall vertical height of the body 12 is 3.17 inches and the nozzle has a diameter of 0.645 inch. The conical distributor or plate deflector 22 has a diameter of 3.675 inches with the central portion 44 having a diameter of 1.66 inches. The radius of curvature where the skirt 46 joins the central circular base 44 is preferably 3/64 inch and the radius of curvature at the shoulder 50 is preferably ⅛ inch. The vertical dimension $l_i$ (FIG. 5) is preferably ⅛ of an inch. The annular flange portion 48 is preferably angled downwardly at an angle a equal to 12°. The large drop deflector preferably has an overall diameter of 1.65 inches and the teeth or tines 56 have a length $l_{ii}$ from the inner face of the central circular member 52 of 0.15 to 0.16 inch. The overall dimension of the blank 60 from which the large drop deflector is fabricated is 1.890 inches and the diameter of the central portion 52 is 1.54 inches. It is presently preferred that the large drop deflector and the plate distributor be fabricated from 0.050 thick brass coil material.

The unique sprinkler head in accordance with the present invention possesses substantial advantages over the prior sprinkler head constructions in that it is able to effectively control and extinguish high-heat output fires producing more than 250,000 BTU/min. The sprinkler head is preferably fabricated with standard threads externally on the body so that it may be used as a replacement in existing sprinkler systems. Further, the unique sprinkler head permits the design of sprinkler systems having fewer sprinkler heads than heretofore possible, reduces piping and supply requirements and therefore possesses substantial cost economies.

It is intended, however, that the above description should be considered as that of the preferred embodiment only. The true spirit and scope of the present invention may be determined by reference to the appended claims.

The embodiments of the invention in which an exclusive property or privilege is claimed are defined as follows.

1. An improved upright sprinkler head of the automatic type including a nozzle, a pair of arms extending outwardly and upwardly from said nozzle and being joined at their ends by a member positioned opposite and aligned with said nozzle, said improvement comprising:

a concave plate distributor defining a cup-shaped central portion opening towards said nozzle, said cup-shaped central portion including a circular, generally planar base secured at its center to said member and a generally cylindrical wall extending around the periphery of said base towards said nozzle, said plate distributor further including a radially, outwardly and downwardly extending annular flange having a generally concave shape and being joined to the periphery of said cylindrical wall to define a shoulder, the outer peripheral edge of said flange being in a single plane; and large drop deflector means carried by said plate distributor and positioned within said cup-shaped central portion for generating large drops of liquid, said large drop deflector means being generally cylindrical and including a plurality of tines, said tines being equally spaced around the periphery of said deflector means and extending towards said nozzle beyond said shoulder and generally perpendicular to said base.

2. An improved upright sprinkler head of the automatic type including a nozzle, a pair of arms extending outwardly and upwardly from said nozzle and being joined at their ends by a member positioned opposite and aligned with said nozzle, said improvement comprising:

a concave plate distributor defining a cup-shaped central portion opening towards said nozzle, said cup-shaped central portion including a base secured at its center to said member and a cylindrical wall extending around the periphery of said base towards said nozzle, said plate distributor further including a radially, outwardly and downwardly extending annular flange having a generally concave shape and being joined to the periphery of said cylindrical wall to define a shoulder, the outer peripheral edge of said flange being in a single plane; and large drop deflector means carried by said plate distributor and positioned within said cup-shaped central portion for generating large drops of liquid, said large drop deflector means being generally cylindrical and including a plurality of tines, said tines being equally spaced around the periphery of said deflector means and extending towards said nozzle beyond said shoulder, said tines terminating intermediate said shoulder and the plane of the peripheral edge of said annular flange.

3. An improved sprinkler head as defined by claim 2 wherein said tines extend generally perpendicular to said base of said central portion of said plate distributor.

4. An improved sprinkler head as defined by claim 3 wherein said tines are generally frusto-conically shaped and taper towards said nozzle.

5. An improved sprinkler head as defined by claim 4 wherein the included angle between adjacent sides of adjacent tines is approximately 22°.

6. An improved sprinkler head as defined by claim 5 wherein said tines are equally spaced at 18° intervals.

7. An improved sprinkler head as defined by claim 6 wherein said annular flange has a truncated cone shape and extends downwardly from horizontal at an angle of 12°.

8. A nonatomizing, upright sprinkler head, comprising:

a nozzle;

a support frame including a pair of arms extending upwardly from said nozzle and being joined opposite said nozzle;

a dish-like, generally circular, large deflector including a circular, generally planar base supported on said arms coaxially with said nozzle, a peripheral skirt extending around the periphery of said circular base and extending downwardly therefrom and a concave, frusto-conical, annular plate extending outwardly and downwardly from the periphery of said peripheral skirt to thereby define a shoulder, said annular plate having an outer peripheral edge lying in a single plane; and a small deflector positioned against said peripheral skirt and contacting said base for generating large drops of liquid, said small deflector defining a plurality of radially positioned fingers each having a root below the shoulder of said large deflector and extending towards said nozzle beyond said shoulder whereby liquid emanating from said nozzle reaches said fingers as a thick sheet, is broken into large drops by said small deflector and the annular plate establishes the outer pattern of liquid discharge.

9. A nonatomizing, upright sprinkler head as defined by claim 8 wherein said small deflector includes a circular, generally planar member having a diameter less than the diameter of said circular base of said large deflector, said fingers extending outwardly then downwardly from the periphery of said circular member and terminating intermediate said shoulder and the plane of the peripheral edge of said annular plate.

10. A nonatomizing, upright sprinkler head as defined by claim 9 wherein said fingers are spaced at equal intervals around said circular member and extend generally perpendicular to said member.

11. A nonatomizing, upright sprinkler head as defined by claim 10 wherein the spacing between adjacent fingers includes an angle from the center of said circular member of 18°.

12. A nonatomizing, upright sprinkler head as defined by claim 11 wherein said fingers are tapered.

13. A nonatomizing, upright sprinkler head as defined by claim 12 wherein the included angle between adjacent sides of adjacent fingers is 22°.

14. A nonatomizing, upright sprinkler head as defined by claim 13 wherein said annular plate of said large deflector extends downwardly at an angle of 12° from horizontal.

* * * * *